US006877178B2

(12) United States Patent
Chapman et al.

(10) Patent No.: US 6,877,178 B2
(45) Date of Patent: Apr. 12, 2005

(54) INFLATABLE SUPPORT

(75) Inventors: Paul William Chapman, Biggleswade (GB); Jane Harbige, Milton Keynes (GB); Daniel Kemp, Enfield (GB); Anthony George Smith, Boreham Wood (GB)

(73) Assignee: Huntleigh Technology, PLC, Luton (GB)

( * ) Notice: Subject to any disclaimer, the term of this patent is extended or adjusted under 35 U.S.C. 154(b) by 0 days.

(21) Appl. No.: 10/381,302

(22) PCT Filed: Mar. 15, 2002

(86) PCT No.: PCT/GB02/01225

§ 371 (c)(1),
(2), (4) Date: Mar. 24, 2003

(87) PCT Pub. No.: WO02/074222

PCT Pub. Date: Sep. 26, 2002

(65) Prior Publication Data

US 2003/0182728 A1 Oct. 2, 2003

(30) Foreign Application Priority Data

Mar. 15, 2001 (GB) ..... 0106340
Jan. 30, 2002 (GB) ..... 0202235

(51) Int. Cl.[7] ..... A47C 27/10
(52) U.S. Cl. ..... 5/713
(58) Field of Search ..... 5/710, 713

(56) References Cited

U.S. PATENT DOCUMENTS 3,462,778 A * 8/1969 Whitney ..... 5/713
3,879,776 A * 4/1975 Solen ..... 5/665
4,015,928 A 4/1977 Carlson
4,120,278 A 10/1978 Ward
4,150,654 A 4/1979 Heitzman et al.
4,220,312 A 9/1980 Pauliukonis
4,527,715 A 7/1985 Rosenbaum
4,833,461 A 5/1989 Yeager
4,904,830 A 2/1990 Rizzuto
4,940,861 A 7/1990 Rizzuto
5,117,518 A 6/1992 Schild
5,179,920 A 1/1993 Bender
5,183,518 A 2/1993 Radon
5,189,742 A * 3/1993 Schild ..... 5/713
5,251,349 A 10/1993 Thomas et al.
5,396,671 A * 3/1995 Stacy ..... 5/655.3
5,611,772 A 3/1997 Fujimoto et al.
5,651,153 A 7/1997 Goodrich
5,774,917 A 7/1998 Liu (Continued)

FOREIGN PATENT DOCUMENTS

EP 0 560 563 A 9/1993
GB 2 307 402 A 5/1997
WO WO 01/09695 A 2/2001
WO WO 01/74287 A 10/2001
WO WO 02/45641 A1 6/2002

*Primary Examiner*—Sunil Singh
(74) *Attorney, Agent, or Firm*—Brown Raysman Millstein Felder & Steiner LLP

(57) ABSTRACT

A pressure pad has two sets of cells with a sensor pad positioned under the pad. During inflation, part of the flow goes to the sensor pad to exhaust and the rest fills the cells. Any change in patient position/weight causing a change in airflow in tube will alter the differential pressure measured at a pressure transducer. Based on this feedback a microprocessor directly controls the power level to the pump, thus adjusting the airflow to the cells to prevent bottoming or to rung at a minimum pressure. The pressure pad is segmented into a heel section, upper leg section, torso section, and a head section. The heel, head, and upper leg sections are maintained at a lower pressure, and the torso section at a higher pressure. A control module to control the flow in the segments is provided inside the pressure pad. The pressure pad can be an alternating or static pad.

15 Claims, 3 Drawing Sheets

U.S. PATENT DOCUMENTS

| | | | |
|---|---|---|---|
| 6,021,800 | A | 2/2000 | Schild et al. |
| 6,058,538 | A | 5/2000 | Chapman et al. |
| 6,098,222 | A | 8/2000 | Hand et al. |
| 6,134,732 | A | 10/2000 | Chapman et al. |
| 6,148,461 | A | 11/2000 | Cook et al. |
| D446,674 | S | 8/2001 | Chapman et al. |
| 6,349,439 | B1 | 2/2002 | Cook et al. |
| 6,385,804 | B1 | 5/2002 | Barber et al. |
| 6,412,129 | B1 | 7/2002 | Wu |
| 6,686,711 | B2 | 2/2004 | Rose et al. |
| 6,701,558 | B2 | 3/2004 | VanSteenburg |

* cited by examiner

INFLATABLE SUPPORT

This application is a national phase entry of PCT application PCT/GB02/01225, filed 15 Mar. 2002, which claims benefit of United Kingdom patent applications 0106340.3, filed 15 Mar. 2001, and 0202235.8, filed 30 Jan. 2002.

The present invention relates to a pressure controlled inflatable pad apparatus, in particular, a pressure controlled alternating or static inflatable pressure pad apparatus.

BACKGROUND OF THE INVENTION

Alternating pressure pads are well known for the prevention and management of decubitus ulcers in bedridden patients. The formation of decubitus ulcers, commonly known as bedsores, results from, amongst other things, the pressure applied to certain portions of the skin of a bedridden patient.

Alternating pressure pads generally comprise two sets of alternately inflatable cells; the duration of the inflation and deflation cycles may last from under two minutes for a gentle massaging effect to over twenty minutes.

A high air pressure in the pads may be needed to support the bony protuberances of a patient and to ensure that the patient is lifted sufficiently away from deflated cells of the pad so that adequate pressure relief is provided. A low air pressure, however, is desirable since it provides a pad that is softer and more comfortable. Optimal pressure support therefore not only varies from patient to patient but also during a given inflation cycle of the pad since the pressure supporting points will change during a cycle. The required optimal support pressure will vary even more as a patient changes from a supine to a sitting position.

It is known to provide an automatic pressure controller comprising a sensor pad that is compressible in dependence upon a patient's weight distribution on the alternating pressure pad. If the patient is not suitably supported, the sensor pad will reduce the escape of fluid to exhaust thereby ensuring that more fluid is supplied to the alternating pressure pad until that patient is supported as required.

The fluid flows from the fluid supply line through the pressure pad and from the pressure pad through the sensor pad to exhaust or directly from the sensor pad to exhaust.

This arrangement necessitates the use of multiple connecting tubes between the pump and the mattress. This method is purely pneumatic without any electrical or electronic content added to the mattress, and the pump has to operate continuously at full output for effective performance. The system has to be set up individually when installed. Also, where the sensor pad is within the fluid circuit supplying the pressure pad, the sensor performance is dependent both on the fluid circuit and overall system pressure drops. Moreover, the static performance of the pressure pad is not as effective as the alternating performance as the optimum static pressure cannot be set. It is also known to have a sensor pad within the air circuit as described above but where the fluid is returned back to the pump. The system is prone to the same problems as outlined above.

SUMMARY OF THE INVENTION

The present invention seeks to make improvements.

According to the present invention, there is provided a pressure pad comprising at least two sets of inflatable cells; a fluid supply line to each set of cells; a pump arrangement to inflate each set of cells via the supply lines; a sensor, a separate supply line connected to the sensor for fluid to flow through the sensor to exhaust, the sensor located beneath the cells; and control means controlling the output of the pump to increase or decrease a supply of fluid to the cells in dependence on the rate of flow of fluid to the exhaust from the sensor. The invention eliminates the need for maximum compressor output at all times with separate pressure control and wasted compressor output. This has the advantage of increased compressor life and lower running costs.

Preferably, the control means controls the output of the pump by varying a pulse width modulated drive signal for the compressor(s) in dependence on the rate of flow at sensor exit or exhaust. Preferably, the sensor comprises at least one compressible tube arranged in a convoluted path within a sensor pad.

Preferably, a pressure difference across a restrictor at the sensor pad exit or exhaust determines the rate of flow.

Preferably, the supply of fluid through the sensor pad to exhaust vents into a space between the inflatable cells within the pressure pad, to provide a humidity gradient across the pad for greater patient comfort.

Preferably, the cells are arranged as a plurality of inflatable segments, the supply lines to the cells being respectively further provided with valves to allow the separate segments to be inflated to different support pressures, and more preferably the valves and their control are located within the pressure pad.

Preferably, all the inflatable segments are inflated to a first support pressure, the segments supporting the heels of a user lying upon or otherwise supported by the pad and maintained at the first support pressure, and the segments supporting at least a torso of the user further inflated and maintained at a second support pressure, the second support pressure higher than the first. Preferably, the cells supporting the heel and/or the head are of a smaller size for better pressure relief.

Preferably, the valves automatically close in the event of no power, for example a loss of power to at least one of the control means and the pump, thus preventing deflation of the cells and providing support for a user during power failure or during transport when power is not available.

Preferably, at least one segment of cells supporting the torso of a user is deflated separately to facilitate user entry or exit from the pressure pad. Preferably, the supply lines to the cells and sensor pad are located beneath the pressure pad to allow for easy exit by a user from the side of the pressure pad.

Additionally, the segments of the inflatable cells supporting the head and heels of a user of the pad can be deflated to provide proning of the user.

Preferably, each cell can be deflated individually to provide pressure relief to the different parts of the body supported thereon.

BRIEF DESCRIPTION OF THE DRAWINGS

The present invention will now be described in detail, by way of example only, with reference to the accompanying drawings in which.

DETAILED DESCRIPTION OF PREFERRED EMBODIMENTS

Figure 1:
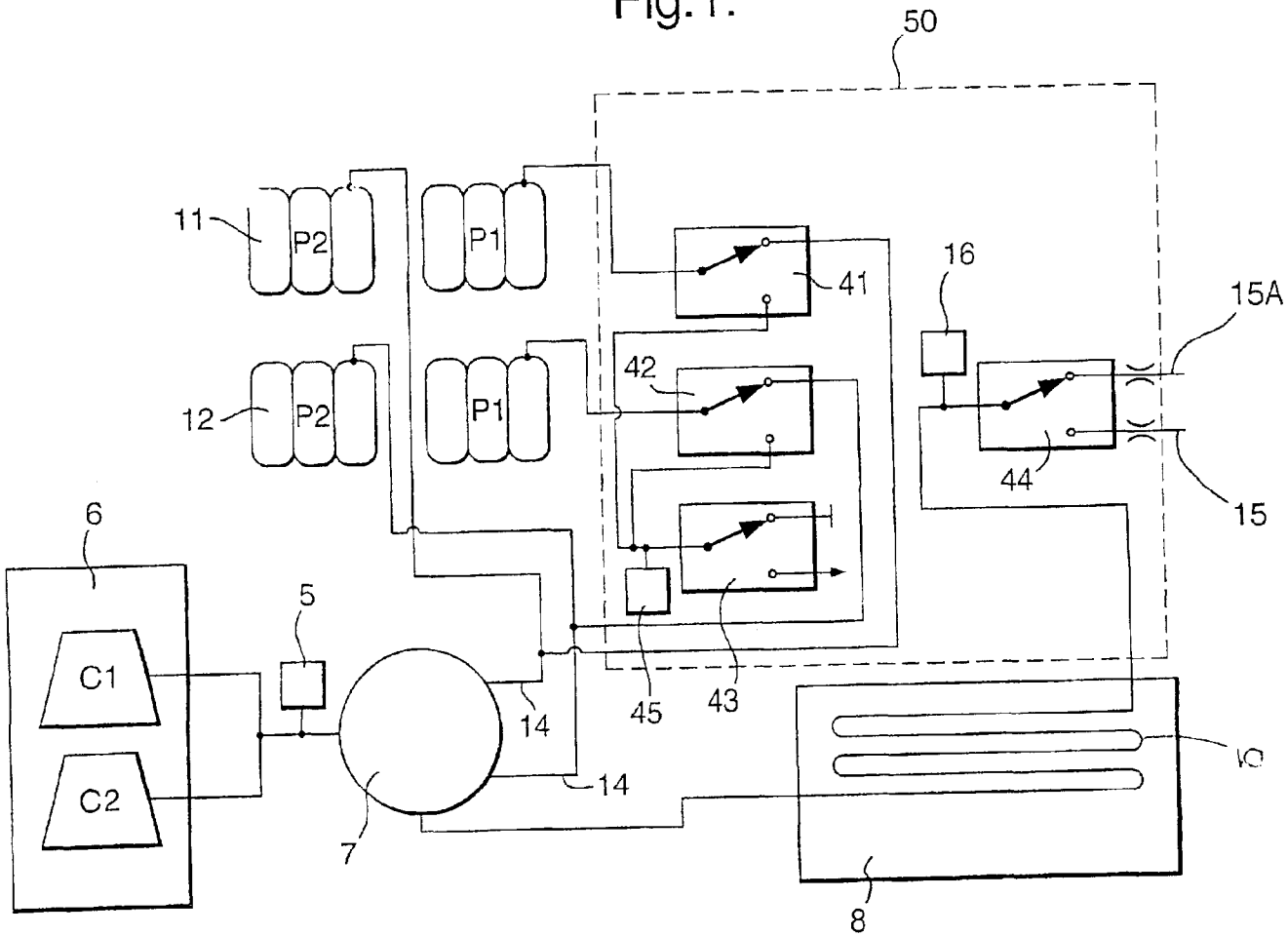
FIG. 1 shows a schematic diagram of an alternating pressure pad according to the invention.

Referring to FIG. 1, an alternating pressure pad 1 (see also FIGS. 2, 3, 4) comprises a first set 11 and a second set 12 of alternately inflatable cells. Both sets of inflatable cells are supplied with air from a pump 6 via a rotary valve 7. A pair of air supply lines 14 lead from the rotary valve 7 to the pad.

A tube 10 of a sensor pad 8 is connected at one end to the output of the pump 6 and at the other end to a solenoid 44, pressure transducer 16 and two different exhaust flow restrictors 15 and 15*a*. The tube 10 comprises a portion which is positioned under the pad 1 to receive pressure exerted by a patient and to be compressible depending on the pressure applied.

The compressible portion of the tube 10 is, in this embodiment, a single compressible tube arranged in a convoluted path and formed as a sensor pad 8. The pad 8 may be formed of two polyurethane sheets welded together to define a single convoluted tube. In an alternative embodiment (not shown), the two sheets may he welded together with foam in between to define a single or a plurality of interconnected tubes. The open celled foam may be welded inside the tube 10 to act as a spring and to keep the tube 10 open unless a positive direct force is applied, for example, a patient sinking through the cells 11 and 12. The foam prevents the tube 10 kinking and increases both accuracy and consistency of the sensor pad 8.

In use, the pump 6 includes two compressors C1, C2 to deliver air to the pad 1 by means of a rotary valve 7 so that each set of cells of the pad is alternately inflated and deflated. The two compressors C1, C2 are both run together when first switched on for maximum flow and rapid fill, then they are reduced in flow to give the required flow. A pressure transducer 5 is used to check the pressure of the output from the pump 6. Operating the pump 6 in this way means that each compressor C1 or C2 has the lowest shuttle amplitude and therefore stress. This reduces both noise and vibration, and gives a very long life. If one should fail, the other compressor operates at increased power and the service engineer alarm is activated. Thus the reliability of the overall system is increased. Of course, a single compressor can also be used. The system operates on an inflation/deflation cycle repeating over periods varying from two minutes to over twenty minutes. In a preferred embodiment the cycle time is 10 minutes.

During the inflation cycle, the rotary valve 7 is in such a position that a portion of the flow goes via the tube 10 and the rest fills the cells 11 or 12 depending on the cycle. Any change in patient position or weight, which causes an alteration in airflow in the sensor tube pad 10, will reduce or increase the differential pressure measured at the pressure transducer 16. Based on this feedback a microprocessor directly controls the power level to the compressors C1, C2 and therefore the compressor's pneumatic output, thus increasing or decreasing the air flow to the cells to either prevent bottoming or to run the pressure pad 1 at a minimum pressure.

Solenoid-controlled valve 44, pressure transducer 16 and exhaust flow restrictors 15, 15*a* act as a switched two range flow sensor where flow is measured via the differential pressure across the exhaust flow restrictors 15 or 15*a* depending on whether the pressure pad is in alternating or static mode. The differential pressure is measured by pressure transducer 16 by comparison to atmospheric pressure.

For optimal inflation pressures of the pressure pad in static or alternating mode, a preset pressure for the sensor pad is determined by experiment depending on the level of comfort required by the patient. A control band around the preset pressure is established where, depending on whether the actual sensor pad pressure is above or below the preset value, the output level of the compressor is varied according to the difference between the preset value and the actual sensor pad pressure measured. The air from the sensor pad exit is vented inside the pressure pad 1 to control the humidity gradient across the cover.

Figure 2:
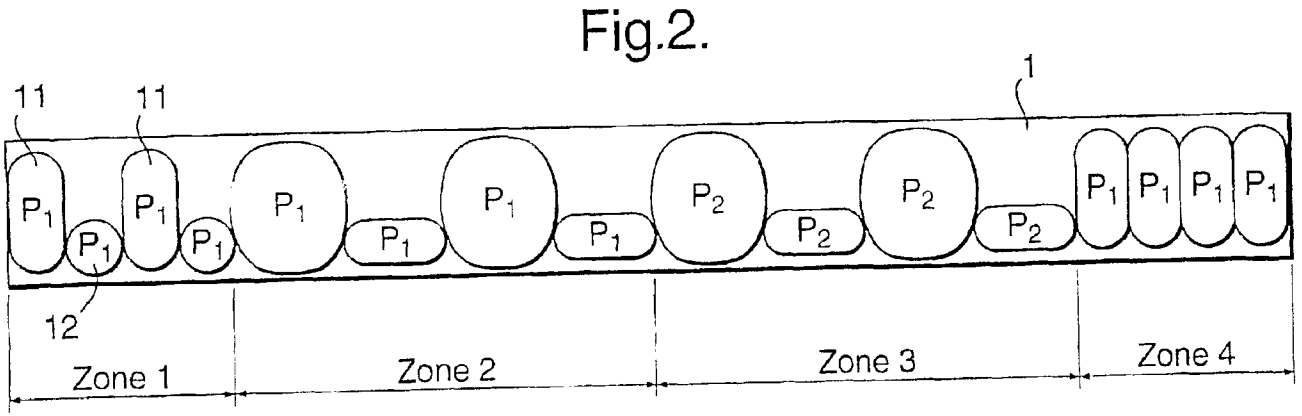
FIG. 2 shows a zoning arrangement suitable for use with the alternating pressure pad in FIG. 1.

Additionally, as shown in FIG. 2, the pressure pad 1 is segmented into zones for a heel section (zone 1), an upper leg section (zone 2) a mid torso section (zone 3), and a head section (zone 4). The heel, upper leg, and head section are inflated at one pressure P1 and the torso section is at a higher pressure P2. As shown in FIG. 1, the supply lines 14 are provided with solenoid-controlled valves 41, 42, and 43 and pressure transducer 45 to control the pressures P1 and P2 within the respective segments of cells 11 and 12. A control module 50 is provided inside the pad 1.

The control module 50 comprises a manifold made up from two mouldings forming air channels and upon which are mounted the solenoid-controlled valves, the pressure transducers and their control. Valve 41 prevents over-inflating of the head and heel cells 11, valve 42 prevents over-inflating of the head and heel cells 12, and valve 43 retains the air in head and heel cells 11, 12.

Solenoid-controlled valve 44 controls the back pressure in the sensor pad by switching between exhaust flow restrictors 15 and 15*a* for static and alternating operation of the pressure pad.

Thus, the number of supply lines 14 to the pressure pad 1 are kept to the minimum.

In use, during inflation of the cells 11, the pressure in the head and heel sections is monitored by pressure transducer 5 until the required pressure P1 is achieved at which point solenoid-controlled valve 41 or 42 operates to cut off the air flow. Pressure transducer 45 then monitors the pressure P1 in the head and heel section.

The pressures P1 in the head, upper leg and heel sections is substantially lower than the pressure P2 in the torso section. Due to the fact the desired air pressure P2 in the torso section is not established when the head, upper leg and heel pressures P1 need to be shut off, the value of P1 is set proportional to the P2 value from the previous alternating inflation cycle. The highest pressure segment is kept at its P2 pressure level by direct control from the pump 6 via feedback from the sensor pad 8, and can be sealed using the rotary valve 7 when required. The torso section can be set to different comfort pressures by adjusting the sensor pad preset pressure values controlling the compressors' output.

During the time that the cells 11 are fully inflated a combination of rotor position and solenoid operation can allow a cell segment to be opened, its pressure checked by pressure transducer 45 and then topped up with air or resealed as required. This method saves the need for multiple costly pressure transducers controlling the pressure in each segment.

Figure 3:
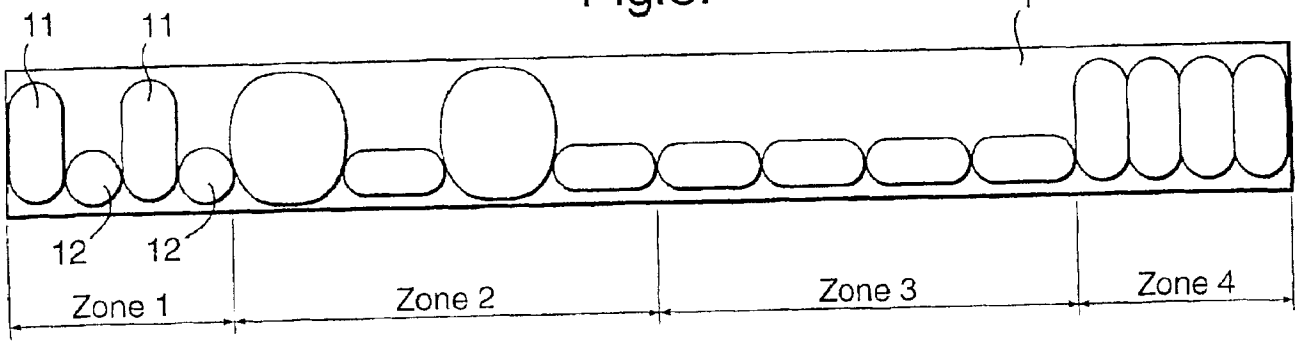
FIG. 3 shows a sacral deflate arrangement suitable for use with the alternating pressure pad in FIG. 1.

Similar use of the solenoids provides additional features of the torso section being deflatable to a safety cell depth to allow patient ingress/egress off the pressure pad, as shown in FIG. 3, since it is known that patients find it difficult to get on or off a fully inflated pressure pad. This feature of torso cell deflation can be patient controlled.

Figure 4:
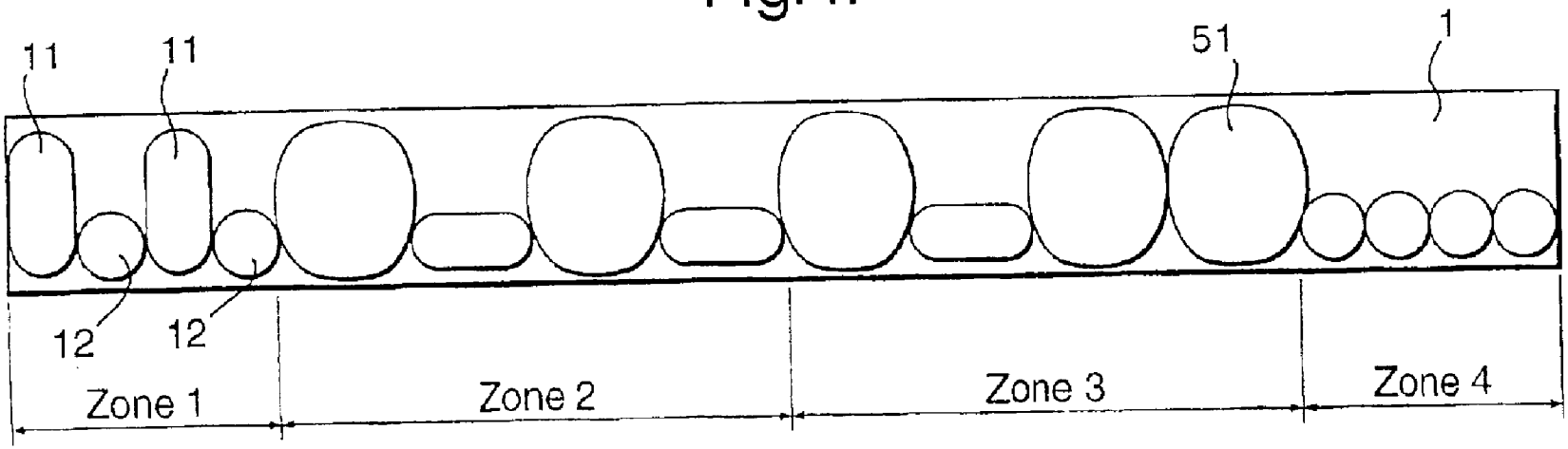
FIG. 4 shows a proning arrangement suitable for use with the alternating pressure pad in FIG. 1.

Alternatively, as shown in FIG. 4, the head section can be deflated whilst the torso section first cell 51 is kept inflated and upper leg and heel sections are alternately inflated to provide a proning position for a patient. The upper leg and heel section cells may also be individually deflated to provide pressure relief where necessary. Therefore, any cell within the pressure pad may be deflated individually to provide individual areas of pressure relief.

Although the particular embodiment described above relates to an alternating pressure pad 1, the invention applies equally to a static pressure pad with a sensor pad and having head, upper leg, torso and heel sections at differing pressures P1 and P2.

The pump 6 uses powered pulse width modulated (PWM) driven compressors as opposed to the mains alternating current driven compressors of the prior art. A micro-controller creates the driving waveform for the compressors C1, C2 with variable mark space constant repetition rate and constant amplitude, so that the pump 6 is not dependent for performance on any particular mains voltage or frequency. Therefore, the pump 6 can be operated from the mains voltage of any country. The compressors output is varied by varying the PWM mark space ratio from zero to maximum. Therefore, the cell pressure P1, P2 is controlled by varying the PWM drive of the compressor C1, C2, eliminating the need for maximum compressor output at all times with separate pressure control and wasted compressor output. This has the advantage of increased compressor life and lower running costs.

What is claimed is:

1. A pressure pad comprising at least two sets of inflatable cells; a fluid supply line to each set of inflatable cells; a pump to inflate each set of cells via the supply lines; a sensor located beneath the inflatable cells; a separate supply line connected to the sensor for fluid to flow through the sensor to an exhaust; and control means controlling an output of the pump to increase or reduce a supply of fluid to the inflatable cells in dependence on a rate of flow of fluid to the exhaust from the sensor.

2. The pressure pad of claim 1, wherein the control means controls the output of the pump by varying a pulse width modulated drive signal in dependence on the rate of flow at the sensor exhaust.

3. The pressure pad of claim 1, wherein the sensor comprises at least one compressible tube within a sensor pad.

4. The pressure pad of claim 3, wherein a pressure difference across a restrictor at the exhaust determines the rate of flow.

5. The pressure pad of claim 1, wherein the supply of fluid through the exhaust vents into a space between the inflatable cells within the pressure pad.

6. The pressure pad of claim 1, wherein the set of inflatable cells are arranged as a plurality of inflatable segments, the supply lines to the inflatable cells being respectively provided with valves to allow the separate segments to be inflated to different support pressures.

7. The pressure pad of claim 6, wherein the valves are located within the pressure pad.

8. The pressure pad of claim 6, wherein all the inflatable segments are inflated to a first support pressure, at least one segment supporting heels of a user of the pad maintained at the first support pressure, and at least one segment supporting a torso of the user is further inflated to a second support pressure, the second support pressure higher than the first.

9. The pressure pad of claim 8, wherein at least one segment supporting the torso of the user is deflatable separately to facilitate user entry or exit from the pressure pad.

10. The pressure pad of claim 6, wherein the valves automatically close in the event of a loss of power to at least one of the control means and the pump.

11. The pressure pad of claim 6, wherein segments of cells supporting a head and heels of a user of the pad are deflatable to provide proning of the user.

12. The pressure pad of claim 1, wherein the supply lines to the cells and the supply line to the sensor are located beneath the pressure pad.

13. The pressure pad of claim 1, wherein each inflatable cell is deflatable individually to provide pressure relief to individual areas of a body of a user supported thereon.

14. The pressure pad of claim 1, wherein the pressure pad is a static pad.

15. The pressure pad of claim 1, wherein the pressure pad is an alternating pad.

* * * * *